US005588161A

United States Patent [19]

Barradas

[11] Patent Number: 5,588,161

[45] Date of Patent: Dec. 31, 1996

[54] FOOT BATH

[76] Inventor: George Barradas, 15 River View Ct., Greenwich, Conn. 06831

[21] Appl. No.: 552,785

[22] Filed: Nov. 3, 1995

[51] Int. Cl.[6] ..... A47K 3/022

[52] U.S. Cl. ..... 4/662; 4/621; 601/22; 601/104; 601/154; 607/86

[58] Field of Search ..... 4/621, 622; 601/22, 601/66, 78, 104, 154, 158, 166; 607/84, 86, 111

[56] References Cited

U.S. PATENT DOCUMENTS

| | | | |
|---|---|---|---|
| 2,382,637 | 8/1945 | Jacks | 4/622 |
| 2,505,845 | 5/1950 | Alvarez | 4/585 |
| 3,043,294 | 7/1962 | Neff | 601/66 |
| 3,380,080 | 4/1968 | Farrell | 4/622 |
| 3,881,471 | 5/1975 | Grube | 601/158 |
| 3,965,495 | 6/1976 | McNair | 4/622 |
| 4,017,915 | 4/1977 | Prewitt | 4/585 |
| 4,513,735 | 4/1985 | Friedson et al. | 601/66 |

FOREIGN PATENT DOCUMENTS

| | | | |
|---|---|---|---|
| 64178 | 11/1982 | European Pat. Off. | 4/622 |
| 2945866 | 5/1981 | Germany | 4/622 |
| 3409621 | 4/1985 | Germany | 4/622 |
| 3811517 | 4/1989 | Germany | 601/22 |
| 6339509 | 12/1994 | Japan | 4/622 |

*Primary Examiner*—David J. Walczak
*Assistant Examiner*—Charles R. Eloshway
*Attorney, Agent, or Firm*—Alfred E. Miller

[57] ABSTRACT

A wet/dry foot bath having a tub with foldable sides a motor with vibrating coils for reciprocating movement of the tub floor, a rope heating with reflecting plates for radiating heat throughout the floor of the tub, the floor having foot massage bumps and a central arch massager, and a remote control device for operating the foot bath.

9 Claims, 6 Drawing Sheets

FOOT BATH

The present invention relates to a portable foot bath with a tub having collapsible sides for compact packing and shipping.

Portable foot baths are known but they are difficult to operate for some people who have a problem bending down to operate the controls which are usually at floor level. In addition, because of the tub height, it is difficult to package a number of tubs in a single carton, and causing the packing and shipping of foot baths to be relatively costly. Furthermore, the arch of the foot is neglected in massaging while in a foot bath.

SUMMARY OF THE INVENTION

The invention is a wet/dry foot bath or spa having a tub of rubber or soft plastic, and a motor underneath the floor having a vibratory coil which causes limited reciprocating movement of the floor of the tub.

A feature of the present invention is to provide a rope type heater which radiates heat in the entire undersurface of the floor of the tub and is mounted in channels in a heater holder.

A further feature of the present invention is to provide metal reflectors above the rope heater which aids in the transmission of heat generated by the rope heater to substantially all areas of the floor of the foot bath tub.

Another feature of the present invention is to provide an arch support centrally located in the floor of the tub for massaging the arch of a foot, and spaced around it are rounded projections for massaging the foot in general.

Another feature of the present invention is to provide a remote control unit connected by a line cord in the base of the tub so that the user can operate the foot bath without bending down to operate the controls.

A further feature of the present invention is to provide bendable sides of the tub of the foot bath which can be folded over to reduce the overall height of the tub for packing and shipping.

In order that the present invention will be more fully understood it will now be disclosed in greater detail with reference to the accompanying drawings in which:

DESCRIPTION OF THE PREFERRED EMBODIMENTS

Figure 1:
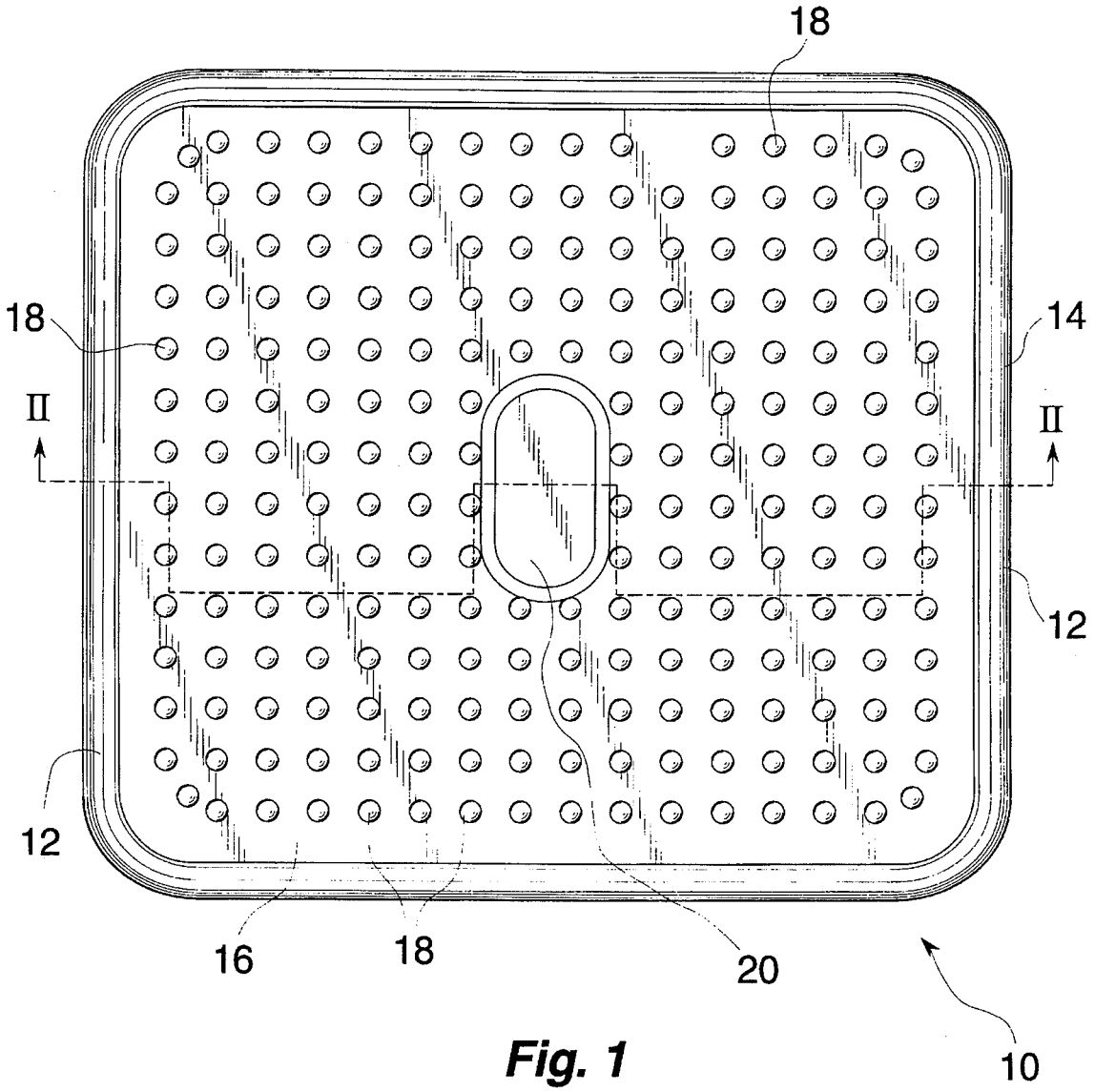
FIG. 1 is a top plan view of a portable foot bath constructed in accordance with the teachings of my invention.
Figures 2, 7:
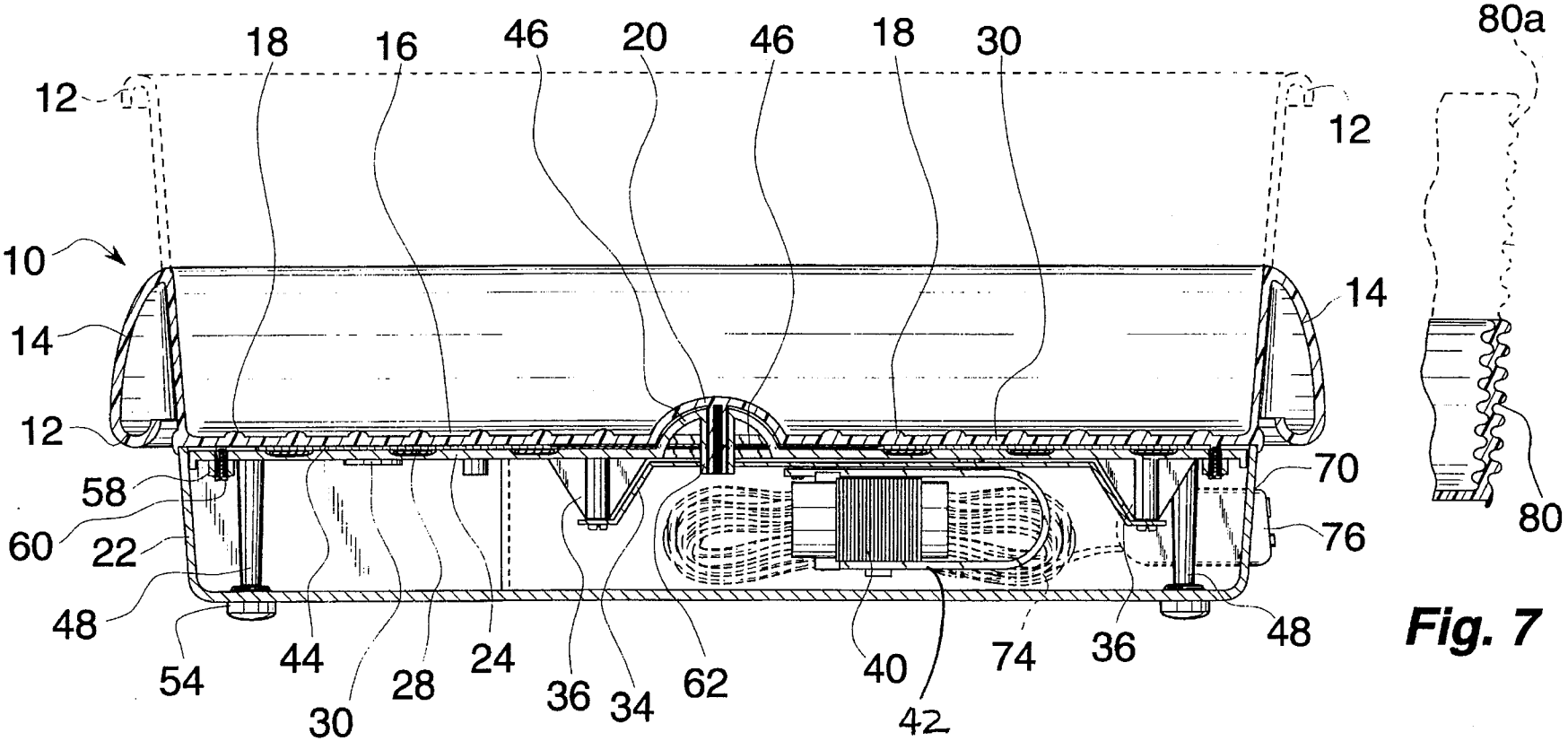
FIG. 2 is a sectional view taken along the lines 2—2 of FIG.
FIG. 7 is a partial sectional view of the tub showing accordion sides which can be folded down for packing and shipping.
Figure 4:
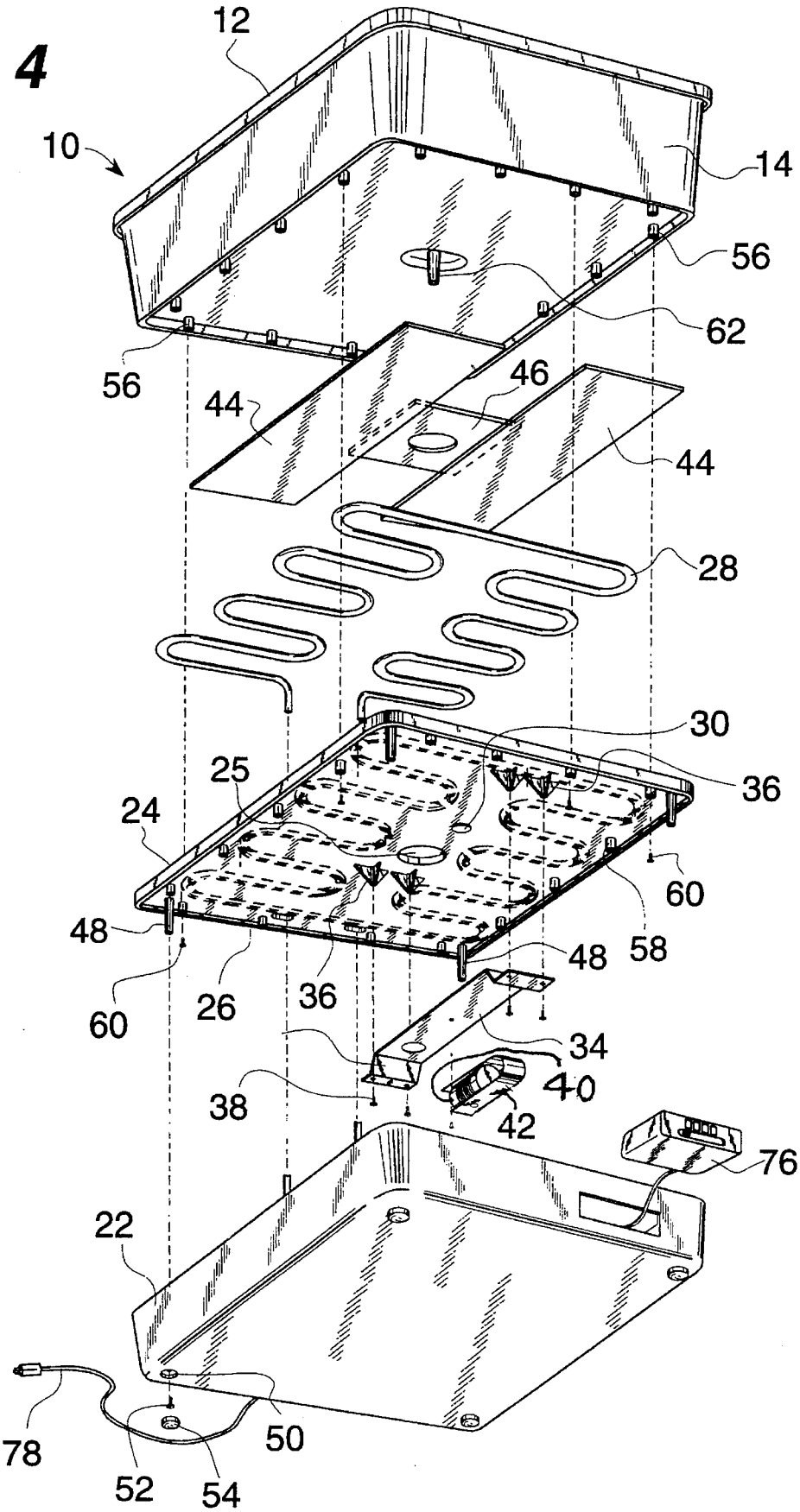
FIG. 4 is an exploded view of all the elements of the present invention.
Figure 5:
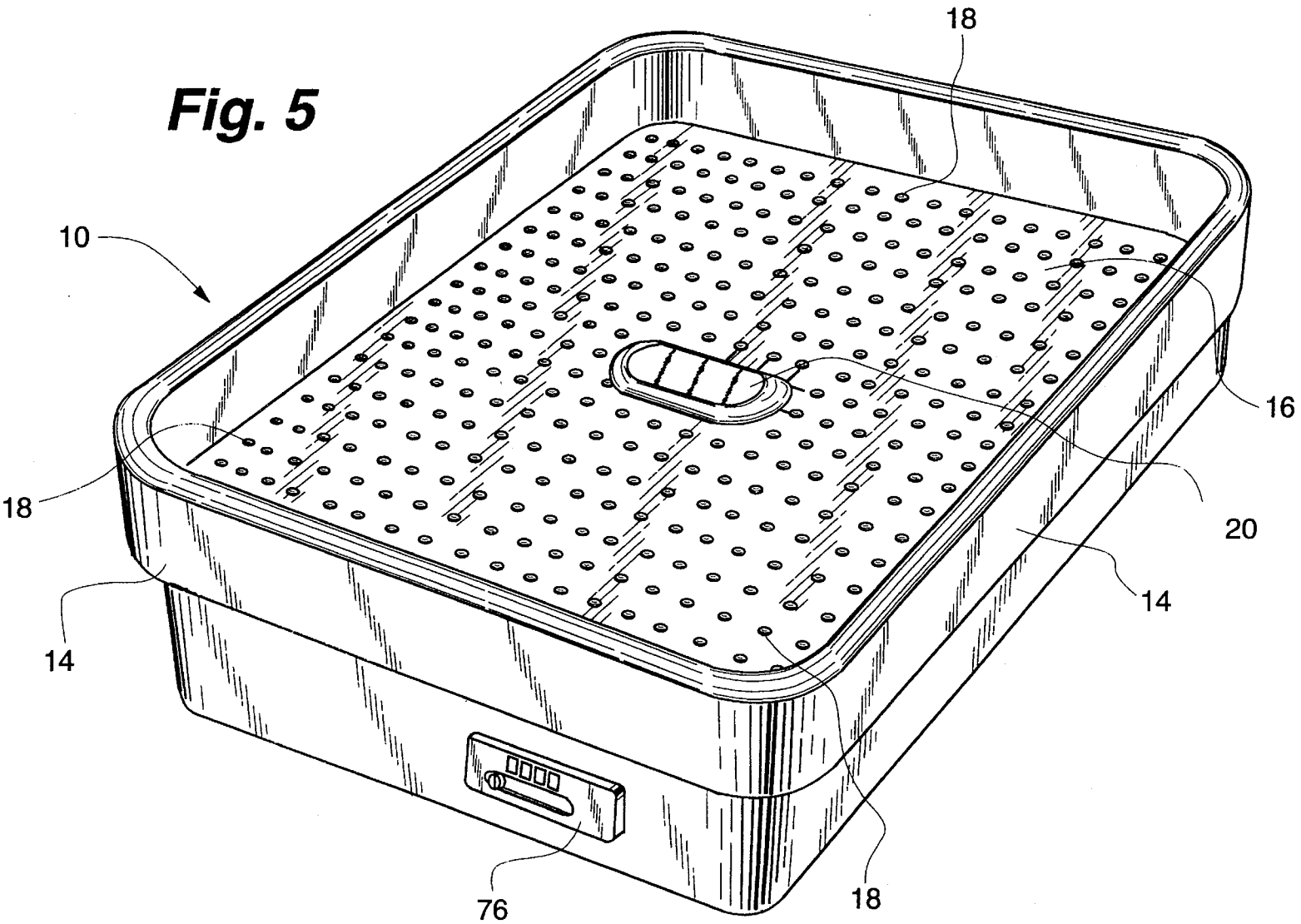
FIG. 5 is a top perspective view of the foot bath showing the remote control unit mounted in the base.

Referring to FIGS. 1, 2 and 5 a portable foot bath is shown provided with a tub 10 fabricated of rubber or a soft plastic, such as vinyl. The tub is generally of a rectangular shape and is provided with a peripheral top edge 12, as seen in FIGS. 2, 4 and 5. The top edge 12 is folded over the sides 14 of the tubs in order to conserve space in a packing carton. However, when it is desired to use the foot bath the top edge 12 is grasped by the user's hands and pulled up to position shown in dotted lines in FIG. 2 and as well as shown in FIGS. 4 and 5. The floor 16 of the tub 10 has spaced shallow, rounded projections 18 which function as foot massaging elements. The floor of the tub also has a centrally located curved arch support 20 which is designed to massage the arch of the foot.

Figure 3:
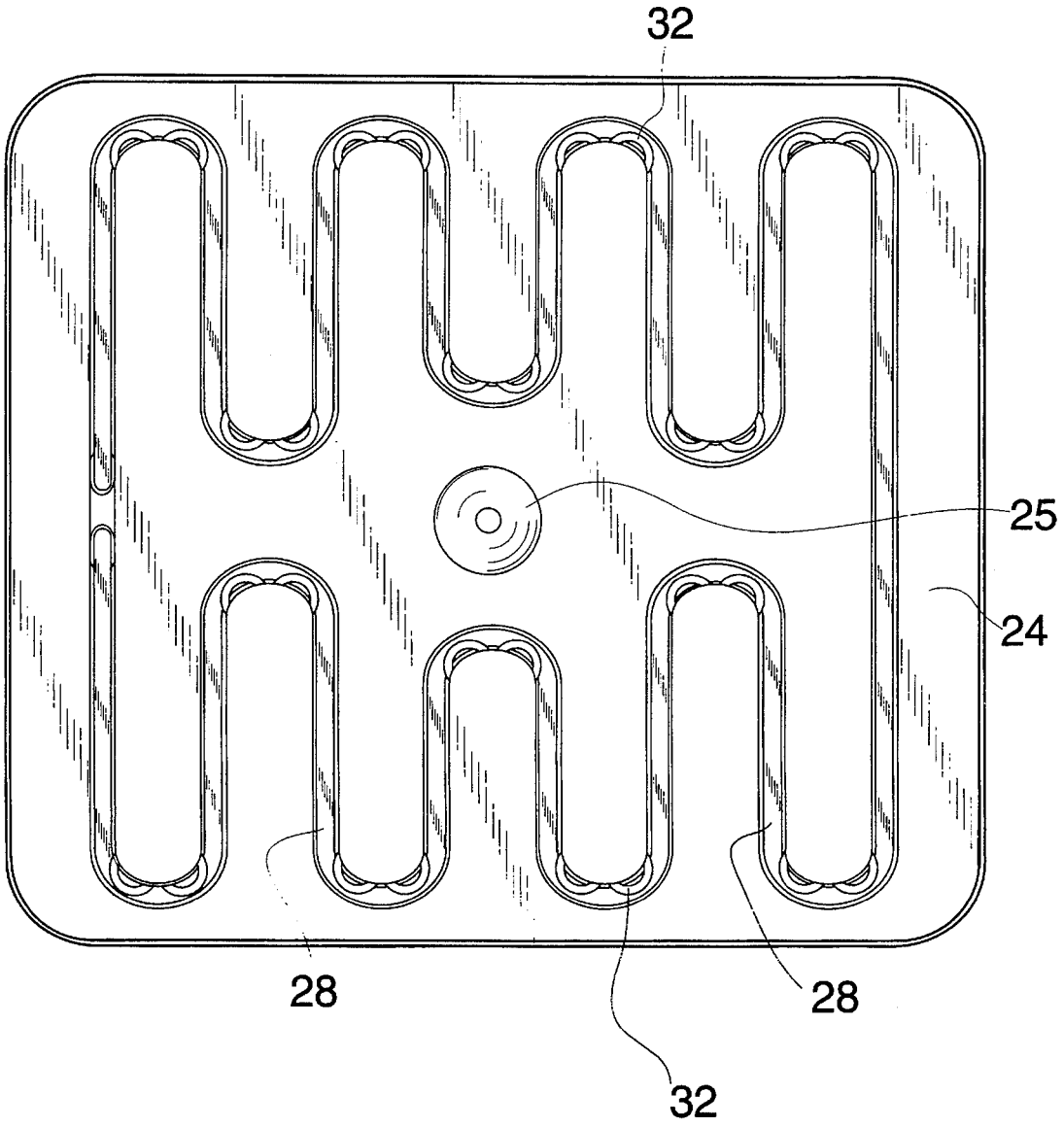
FIG. 3 is a top plan view of a heater platform showing the rope heater placed in heater channels.

Referring now to FIGS. 2 and 4 a heater platform 24 is shown mounted on the base support 22 and has a sinuous channel 26 on the top surface of the platform. The channel 26 is provided with a rope heater 28 within the entire sinuous channel 26 in order to radiate heat throughout the floor 16 of the tub. The heater 28 is connected to a power source (not shown) and is provided with a thermostat 30. The rope heater 28 is held in place by holders 32, as seen in FIG. 3.

A motor bracket 34 is located at the underside of heater platform 28 and is affixed to four bosses 36 projecting downward from the bottom of platform 28 by means of bolts 38.

A motor 40 having a vibrating coil 42 is affixed to the bracket 34. Located above the heater platform 24 having the rope heater 28 are a pair of spaced thin metal reflectors 44 such as aluminum foil. The reflectors 44 are connected by a smaller reflector 46 having a central opening 46 which is aligned with opening 25 in the heater platform 24. All of the metal reflectors abut the underside of the floor of the tub 10 and function to radiate the heat generated by the rope heater throughout the floor 16 of the tub 10.

The heater platform 24 is fixed to the base platform 22 by means of bosses 48 which are placed in holes 50 in the base platform, and attached by screws 52. Non-marking rubber feet 54 cover the screw heads. The tub 10 is affixed to heater platform 24 by means of bosses 56 in tub 10 and aligned bosses 58 in platform 24, and connected by means of screws 60.

On the underside of the floor 16 of the tub 10 is a pipe-like projection 62 which passes through an opening in the metal reflector 46 and opening 25 in heater platform 24 to engage the motor bracket 34 thus imparting vibratory motion of the motor directly to the arch support 20.

Figure 6:
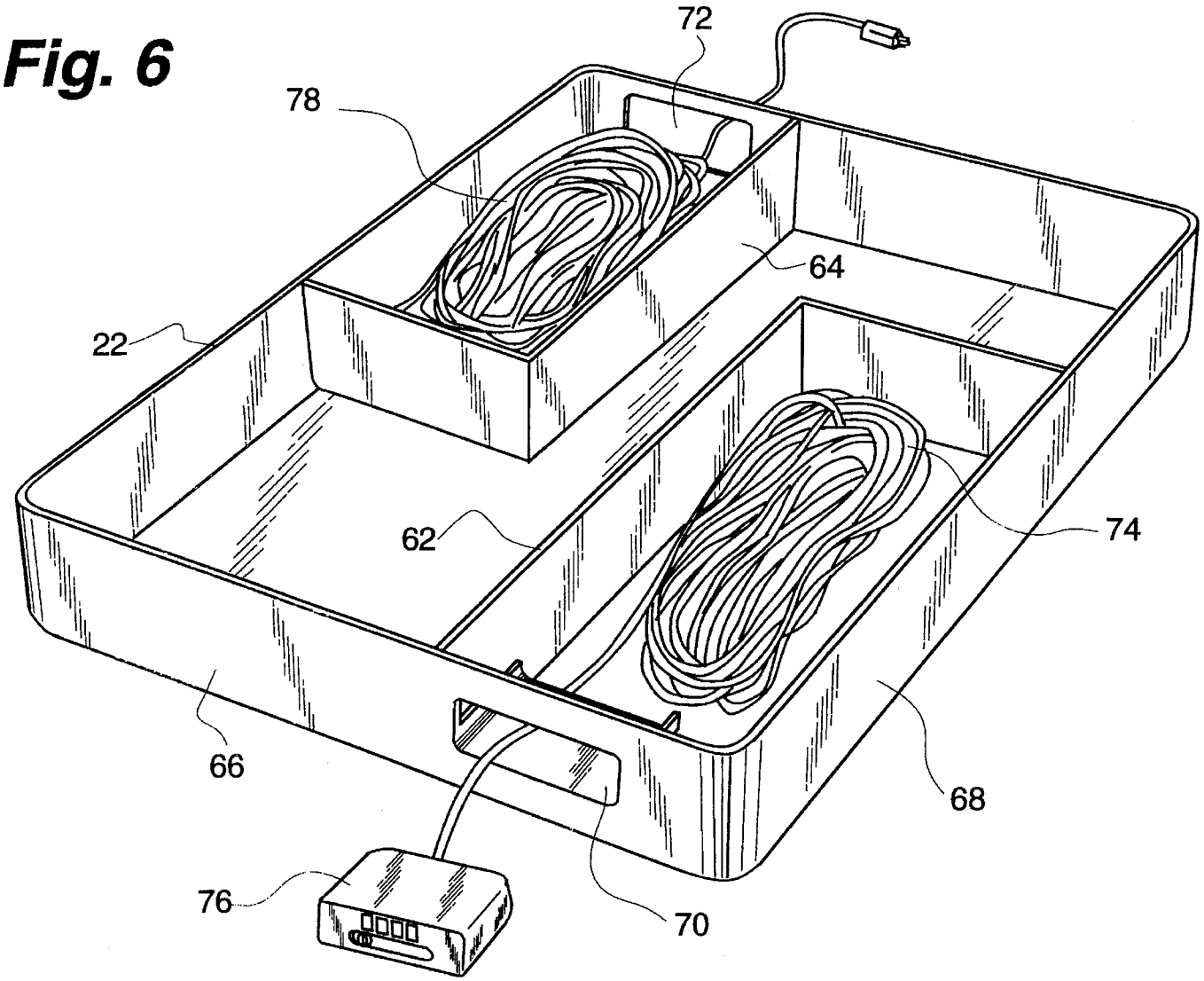
FIG. 6 is a top perspective view of the base platform.

Referring now to FIG. 6, the base platform 22 is provided with compartments 62 and 64 in which compartment 62 has an opening 70 in front wall 66 of the base 22 while compartment 64 has an opening 72 in the rear wall 68 of the base. Located within compartment 62 is a power cord 74 with removable remote control unit 76. In compartment 64 a standard power Cord 78 is shown which can be connected to any 110 Volt AC outlet. The remote control unit 76 can be placed in the opening 70 as shown in FIG. 5, or it may be removed from the opening, as seen in FIG. 6, in order to operate the foot bath from a distance. This arrangement is especially desirable for people who have difficulty bending down and operating the controls since the foot bath device can be operated from a sitting or standing position.

As will be seen in FIGS. 2 and 7, the flexible sides 14 of the tub are folded over, as shown in full lines, for packing and transportation. When the foot bath is desired to be used, the sides 14 are pulled up all around the tub to the dotted line position shown in FIG. 2. Thus the depth of the tub 10 is approximately doubled thereby permitting a higher level of water in the tub. Furthermore, the vibratory, rounded projections spaced throughout the floor 16 of the tub 10, as well as the vibrating arch support 20, rejuvenate the soles and arches of the feet not only in warm water but in dry heat as well.

FIG. 7 shows another embodiment of the present invention wherein the flexible sides 80 are accordion shaped so that tub 10 can be packed and shipped in a collapsed condition, as seen in full lines, or the accordion sides 80*a* can be pulled up to the enlarged tub position for use, as seen in dotted lines.

While the invention has been disclosed and described with reference to several embodiments it will be apparent that changes and modifications may be made therein, and it is intended that the following claims cover each such variation and modification as falls within the true spirit and scope of the present invention.

What I claim is:

1. A portable foot bath adapted for connection to a power source, comprising a tub having a floor and a base platform connected to said floor for supporting the tub, said platform having a base surrounded by generally vertical side walls, a heater platform supported on said base platform and provided with a heater element on a top surface thereof, a motor having a vibratory coil for vibrating the floor of said tub, said motor located within said base platform and suspended from a bottom surface of said heater platform, said tub adapted for receiving the user's feet and positioned above said heater element, a thin metal heat transmitting panel positioned between said heater element and the floor of said tub engaging the latter as well as said heater element so that heat is radiated throughout the floor of the tub, and spaced rounded projections rising from the floor of the tub for vibratory massage of the feet.

2. The portable foot bath as claimed in claim 1 further comprising a curved arch support projecting upwardly from the floor of said tub for massaging the arch of the foot.

3. The portable foot bath as claimed in claim 1 wherein said tub is fabricated of a soft and flexible material whereby the sidewalls of the tub can be folded over to reduce the overall height of the tub for packing and shipping purposes.

4. The portable foot bath as claimed in claim 3 wherein said soft flexible material of the tub is rubber.

5. The portable foot bath as claimed in claim 3 wherein said soft flexible material of the tub is vinyl.

6. The portable foot bath as claimed in claim 1 wherein the tub is fabricated of flexible material, and the sidewalls thereof have an accordion configuration whereby the sidewalls can be compressed for packing and shipping and expanded upwardly when in use.

7. A portable foot bath adapted for connection to a power source comprising, a tub and base platform for supporting the tub, said platform having a base surrounded by generally vertical sidewalls, a heater platform supported on said base platform and provided with a sinuous channel on a top surface thereof, a rope heater located in said sinuous channel, heater holders for maintaining said heater in said channel, a motor having a coil for vibrating a floor of said tub, a motor mount positioned within said base platform for mounting said motor thereon, said tub being positioned above said heater, a thin metal heat transmitting panel located between the floor of said tub and said heater and engaging the heater and a bottom surface of the floor of said tub so that the heat is radiated generally throughout the floor of said tub, and spaced projections extending from the floor of said tub for vibratory massage of the feet.

8. The portable foot bath as claimed in claim 7 wherein said metal panel is aluminum foil.

9. The portable foot bath as claimed in claim 7 further comprising a curved arch support projecting upwardly from a center portion of said floor for massaging the arch of the foot.

* * * * *